US007015862B2

(12) United States Patent
Takei et al.

(10) Patent No.: US 7,015,862 B2
(45) Date of Patent: Mar. 21, 2006

(54) ANTENNA, METHOD FOR MANUFACTURING THE ANTENNA, AND COMMUNICATION APPARATUS INCLUDING THE ANTENNA

(75) Inventors: Ken Takei, Kawasaki (JP); Hiroyuki Aoyama, Kumagaya (JP)

(73) Assignees: Hitachi, Ltd., Tokyo (JP); Hitachi Metals, Ltd., Tokyo (JP)

( * ) Notice: Subject to any disclaimer, the term of this patent is extended or adjusted under 35 U.S.C. 154(b) by 5 days.

(21) Appl. No.: 10/902,566

(22) Filed: Jul. 30, 2004

(65) Prior Publication Data

US 2005/0099337 A1 May 12, 2005

(30) Foreign Application Priority Data

Nov. 12, 2003 (JP) ..... 2003-382003

(51) Int. Cl.
*H01Q 1/38* (2006.01)
*H01Q 1/50* (2006.01)

(52) U.S. Cl. ..... 343/700 MS; 343/846; 343/850

(58) Field of Classification Search ..... 343/850, 343/860

See application file for complete search history.

(56) References Cited

U.S. PATENT DOCUMENTS 3,753,815 A * 8/1973 Burton et al. ..... 216/109
6,624,795 B1 * 9/2003 Boyle ..... 343/895
6,639,555 B1 * 10/2003 Kane et al. ..... 343/700 MS
6,903,688 B1 * 6/2005 Edvardsson ..... 343/700 MS
2003/0169204 A1 * 9/2003 Saito ..... 343/700 MS

FOREIGN PATENT DOCUMENTS

JP 61-265905 11/1986
JP 01-158805 6/1989

* cited by examiner

*Primary Examiner*—Trinh Vo Dinh
(74) *Attorney, Agent, or Firm*—Miles & Stockbridge P.C.

(57) ABSTRACT

The invention provides a small multimode antenna capable of commonly using a single feeding point at a plurality of frequencies. The antenna includes a radiating conductor 1 disposed above a ground conductor 6 and distributed-constant circuits 2 and 3 coupled to the radiating conductor. Each of the distributed-constant circuits is constructed by a transmission line and has a branch. One end of the radiating conductor and one end of the distributed-constant circuit 2 are connected to each other to be a connection point and, further, the other end of the radiating conductor and one end of the distributed-constant circuit 3 are connected to each other. The connection point is a single feeding point 9 using the ground conductor as an earth. The distributed-constant circuits 2 and 3 are designed as an equivalent circuit in which different stubs are connected in parallel with a transmission line, and impedance matching at a plurality of frequencies is realized at the feeding point.

10 Claims, 11 Drawing Sheets

101
41

104a
69
49

102a
42
63

31
34
35
36
84 32 83

68
104b
67
48

102b
64
43

66
103
47

53
52
51
41
54

ANTENNA, METHOD FOR MANUFACTURING THE ANTENNA, AND COMMUNICATION APPARATUS INCLUDING THE ANTENNA

CLAIM OF PRIORITY

The present application claims priority from Japanese application JP 2003-382003 filed on Nov. 12, 2003, the content of which is hereby incorporated by reference into this application.

FIELD OF THE INVENTION

The present invention relates to an antenna of a wireless apparatus for providing multimedia services to the user. More particularly, the invention relates to a multimode antenna suitable for use in a multimedia wireless apparatus for providing plural services by information transmission using electromagnetic waves of different frequencies as media, a method for manufacturing the antenna, and a communication apparatus including the antenna.

BACKGROUND OF THE INVENTION

In recent years, multimedia services of various information provided by use of radio are becoming active, and a number of wireless apparatuses are developed and provided for practical use. The variety of services is being increased year after year to telephone, television, LAN (Local Area Network), and the like. To enjoy all of the services, the user has to have wireless apparatuses corresponding to the respective services.

To improve the convenience for the user to enjoy such services, movement of providing the multimedia services any time, any where without making the user aware of the existence of the media, that is, in a ubiquitous manner has started, and a so-called multi-mode apparatus realizing a plurality of information transmission services by itself is, though partially, realized.

Since normal ubiquitous information transmission services by radio use electromagnetic waves as a medium, in the same service area, one frequency is assigned per service, thereby providing a plurality of services to the user. Therefore, the multimedia apparatus has the function of transmitting/receiving electromagnetic waves of a plurality of frequencies.

In a conventional multimedia apparatus, for example, a method of preparing a plurality of single-mode antennas each corresponding to one frequency and mounting the antennas on a single wireless apparatus is employed. In the method, to make the single-mode antennas operate independently of each other, the single-mode antennas have to be mounted at intervals of about wavelength. The frequencies of electromagnetic waves used for services related to normal ubiquitous information transmission are limited to hundreds MHz to a few GHz by the free space propagation characteristic. Therefore, the distance between neighboring antennas becomes tens cm to a few meters, the dimensions of the apparatus become large, and portability for the user is not satisfied. Since the antennas having sensitivities to different frequencies are disposed at the intervals, RF circuits coupled to the antennas have to be also separated from each other and installed in correspondence with the different frequencies.

Therefore, it is difficult to apply a semiconductor integrated circuit technique. If the technique is applied, problems occur such that the dimensions of the apparatus become large and, in addition, the cost of the RF circuit increases. If the integrated circuit technique is forcefully applied to integrate all of the circuits, it is necessary to couple the RF circuit to an antenna apart from the RF circuit via an RF cable. The RF cable which can be applied to a terminal of dimensions small enough to be carried by the user has a diameter of about 1 mm. Consequently, the transmission loss of the RF cable reaches a few dB/m under present circumstances. The method has problems such that the consumption power of the RF circuit increases due to use of the RF cable, it causes noticeable reduction in use time of an apparatus providing ubiquitous information service or noticeable increase in the weight of the apparatus due to increase of the volume of a battery, and convenience for the user of the apparatus largely deteriorates.

As another technique, a two-frequency antenna such that one end of a loop antenna or the material of an antenna is coupled to a transmitter using a frequency and the other end is coupled to a receiver using another frequency is disclosed in Japanese Patent Laid-Open Nos. S61(1986)-265905 (Document 1) and H1(1989)-158805 (Document 2).

In the two-frequency antenna disclosed in the document 1, a first resonant circuit is connected to one of ends of a loop antenna as a radiating conductor and a second resonant circuit is connected to the other terminal. The one terminal resonates at a transmission frequency and the other terminal resonates at a reception frequency. A transmission circuit is connected to the one terminal (transmission output terminal) and a reception circuit is connected to the other terminal (reception input terminal).

In the two-frequency antenna disclosed in the document 2, a first resonant circuit which resonates at a transmission frequency and is connected between one of terminals of the material of an antenna as a radiating conductor and a transmission output terminal presents a high impedance at a reception frequency and disconnects the material of the antenna from the transmission output terminal. A second resonant circuit which resonates at a reception frequency and is connected between the other terminal of the material of the antenna and the reception input terminal presents a high impedance at the transmission frequency and disconnects the material of the antenna from the reception input terminal.

SUMMARY OF INVENTION

One of key devices of multimedia wireless apparatuses is a multimode antenna having sensitivities to electromagnetic waves of a plurality of frequencies. The multimode antenna realizes an excellent matching characteristic between the characteristic impedance of a free space at electromagnetic waves of a plurality of frequencies by a single structure and a characteristic impedance of an RF circuit of a wireless apparatus.

The above-described antenna can be said as a kind of the multimode antenna with respect to the point that two frequencies are used. However, separate input/output terminals, that is, feeding points exist in apart positions for different frequencies and a transmission circuit and a reception circuit or a transmission/reception circuit have to be prepared for each of the feeding points. Consequently, it is difficult to integrate those components and reduction in size of a wireless apparatus on which the antenna is mounted is disturbed.

If a feeding point can be shared by electromagnetic waves of different frequencies in a multimode antenna, RF circuits (transmission and reception circuits) using a plurality of frequencies can share one feeding point. Consequently, the semiconductor integrated circuit technique can be applied to integrate the RF circuit section. Thus, the size the RF circuit can be reduced and a small, low-priced wireless apparatus for plural frequencies can be realized.

An object of the invention is to provide a small multimode antenna capable of sharing a single feeding point by a plurality of frequencies to realize an inexpensive and small multimedia wireless apparatus, a method of manufacturing the antenna, and a communication apparatus using the antenna.

An antenna of the invention for achieving the object includes a radiating conductor disposed above a ground conductor and first and second distributed-constant circuits coupled to the radiating conductor. Each of the first and second distributed-constant circuits is constructed by a transmission line and has a branch. One end of the radiating conductor and one end of the first distributed-constant circuit are connected to each other and, further, the other end of the radiating conductor and one end of the second distributed-constant circuit are connected to each other. A connection point of one end of the radiating conductor and one end of the first distributed-constant circuit is a single feeding point using the ground conductor as an earth.

The antenna of the invention having such a structure functions as a multimode antenna in which a feeding point is commonly used at a plurality of different frequencies. Therefore, a plurality of RF circuits using a plurality of frequencies can be integrated, and reduction in the size and cost of the RF circuit is realized. Since the antenna has only one feeding point, the size of the antenna itself can be also reduced. In a conventional antenna, a limited space is needed between neighboring feeding points in order to make a plurality of feeding points operate electrically independent of each other. Preparation of such a space disturbs reduction of the size of the antenna itself very much.

The reason why a single feeding point can be shared by a plurality of frequencies in the invention is because we have invented a novel designing technique different from conventional ones. Since each of the first and second distributed-constant circuits as components of the multimode antenna of the invention has a branch, as will be described in detail later, the first and second distributed-constant circuits become equivalent to a circuit in which different stubs are connected in parallel to a transmission line. By setting so that one stub serves as a tuning circuit at a frequency to which the antenna has sensitivity, in the antenna of the invention, the radiating conductor and the first and second distributed-constant circuits coupled to the radiating conductor operate integrally. In other words, different from the conventional techniques, no short circuit occurs at a frequency so that a part of the radiating conductor is not disconnected from the other part. In such an integral operation, at the single feeding point, almost the same impedances matching an impedance of the free space and the impedance of the RF circuit part or impedances having the relation of complex conjugate can be realized at a plurality of frequencies.

In the case where the distributed-constant circuit constructed by a transmission line is constructed by a wire conductor having a branch, the wire conductor is disposed below the radiating conductor between ground conductors for grounding the antenna. The wire conductor may take the form of, for example, a stripline.

It is conventionally known that impedance matching between RF circuits is performed by using a solid circuit having stubs. In the invention, the radiating conductor is regarded as an RF circuit including, in a resistance component, a free space having a characteristic impedance of 120 π ohms as a space impedance. The principle of the invention is to realize impedance matching at a plurality of frequencies between the radiating conductor regarded as such an RF circuit and the RF circuit connected to a feeding point by a parallel circuit of stubs.

In reality, in designing of the distributed-constant circuit constructed by a transmission line having a branch according to the invention, the circuit is used as a circuit having a parallel circuit of stubs, the radiating conductor electromagnetically coupled to the free space is regarded as a distributed-constant constant type RF circuit having a resistance component, and impedance matching between the radiating conductor and the RF circuit connected to the feeding point is realized. The designing method of the invention has succeeded that, for example, in the configuration of FIGS. 5(*a*) to 5(*e*) and with dimensions of 10×3×4 mm, an excellent impedance matching condition (VSWR<3) less than a standing wave ratio of 3 is assured in bandwidths of 40 MHz and 80 MHz in a two-mode operation of 900 MHz/1.5 GHz.

These and other objects and many of the attendant advantages of the invention will be readily appreciated as the same becomes better understood by reference to the following detailed description when considered in connection with the accompanying drawings.

DESCRIPTION OF PREFERRED EMBODIMENTS OF THE INVENTION

Figure 1:
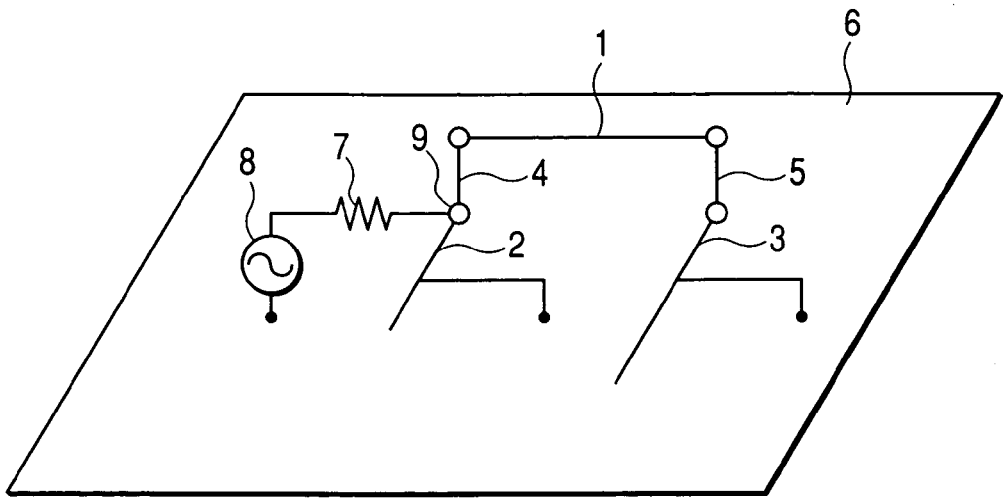
FIG. 1 is a configuration diagram illustrating a first embodiment of an antenna according to the invention.

An antenna according to the invention, a method of manufacturing the antenna, and a communication apparatus including the antenna will be described in more detail with reference to some embodiments shown in the drawings. The same reference numerals in FIGS. 1, 3, 4, 5(*a*) to 5(*d*), 6(*a*) to 6(*e*), 7(*a*) to 7(*f*), 8(*a*) to 8(*f*), 9(*a*) to 9(*f*), 10(*a*) to 10(*h*), 12 and 13 indicate the same or similar components.

Figure 2:
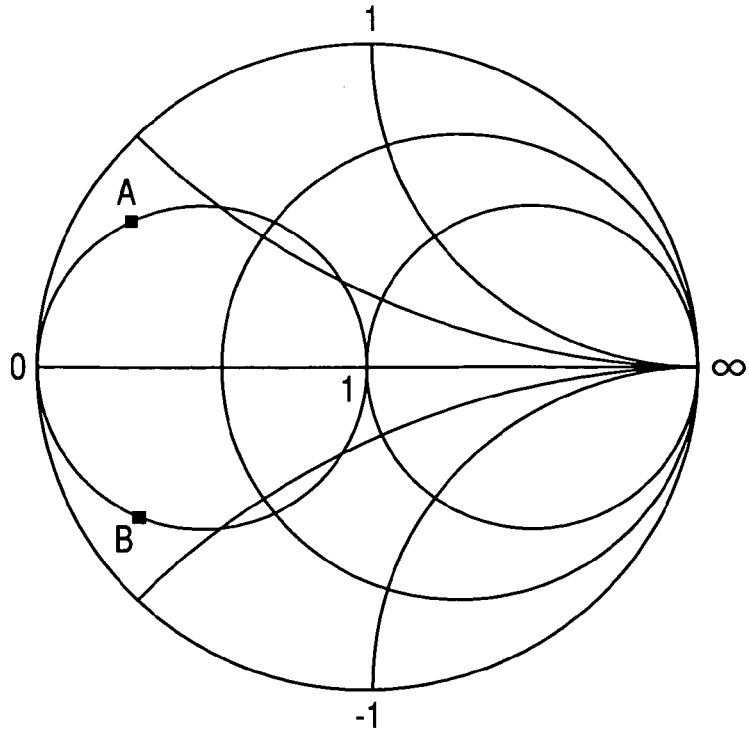
FIG. 2 is a Smith chart for illustrating the characteristics of the antenna of FIG. 1.

A first embodiment of the invention will be described with reference to FIGS. 1 and 2. FIG. 1 is a diagram showing components of an antenna of the invention and coupling relations of the components. FIG. 2 is a Smith chart illustrating the characteristics of the antenna of FIG. 1.

The embodiment shown in FIG. 1 employs the structure such that one end of a radiating conductor 1 and one end of a first connecting conductor 4 are coupled to each other, a wire conductor 2 having a first branch is connected between the other end of the first connecting conductor 4 and a ground (ground conductor) 6, the other end of the radiating conductor 1 and one end of a second connecting conductor 5 are coupled to each other, a wire conductor 3 having a second branch is connected between the other end of the second connecting conductor 5 and the ground 6, and a coupling point between the first connecting conductor 4 and the wire conductor 2 having the first branch is used as a feeding point 9. An external RF circuit part expressed by a serial equivalent circuit of a characteristic impedance 7 and a source 8 is coupled to the feeding point 9 by using the ground 6 as an earth. Further, a wire conductor whose one end is connected to the ground 6 and a wire conductor whose one end is open are connected to the first branch of the wire conductor 2. A wire conductor whose one end is connected to the ground 6 and a wire conductor whose one end is open are connected to the second branch of the wire conductor 3. In such a structure, an RF power is supplied from the RF circuit part to the feeding point 9, and a receiving signal is supplied from the feeding point 9 to the RF circuit part.

The first connecting conductor 4 and the second connecting conductor 5 are components for disposing the wire conductors 2 and 3 below the radiating conductor 1. The wiring conductors 2 and 3 form a distributed-constant circuit. As each of the wiring conductors 2 and 3, for example, a stripline or coaxial line is used. In the case of employing a stripline and placing importance on the gain of the antenna, the minimum line width of the radiating conductor 1 is set to be larger than the maximum line width of the stripline. In the case of employing a coaxial line, the electromagnetic field is confined inside an outer conductor, so that the length of the connecting conductors 4 and 5 can be shortened.

Each of the wire conductor 2 having the first branch and the wire conductor 3 having the second branch is constructed by a transmission line, is a distributed-constant circuit having a branch, and can be expressed by an equivalent circuit in which an open stub and a short stub are joined in parallel with the transmission line.

In the embodiment, by setting the length of the short stub to a ¼ wavelength at a frequency to which the antenna is to have sensitivity, designing of the wire conductor 2 having the first branch and the wire conductor 3 having the second branch can be simplified. At different frequencies in the feeding point 9, the radiating conductor 1, first connecting conductor 4, second connecting conductor 5, and wire conductor 3 having the second branch are set so as to present an admittance having the value of a real part which is almost the same as the characteristic admittance equivalent to the characteristic impedance 7 of the RF circuit part and the value of a specific imaginary part. The wire conductor 2 having the first branch is set so as to have a susceptance value having an absolute value almost the same as the value of the specific imaginary part and which is a value of an opposite sign.

Since the wire conductor 2 having the first branch is connected in parallel with the RF circuit part at the feeding point 9, the admittance having the susceptance value has to be close to the point A or B in FIG. 2. When the Smith chart is normalized by the characteristic impedance of the RF circuit part, the circle in the diagram in which the points A and B exist is the locus of the characteristic admittance expressed by pure resistance components equivalent to the characteristic impedance.

Therefore, when the points A and B are on the locus of the characteristic admittance, perfect matching can be realized between the RF circuit part and the antenna of the embodiment. In other words, the antenna of the invention can have perfect matching with the RF circuit part when the admittance having the susceptance value exists near the locus of the characteristic admittance.

Figure 4:
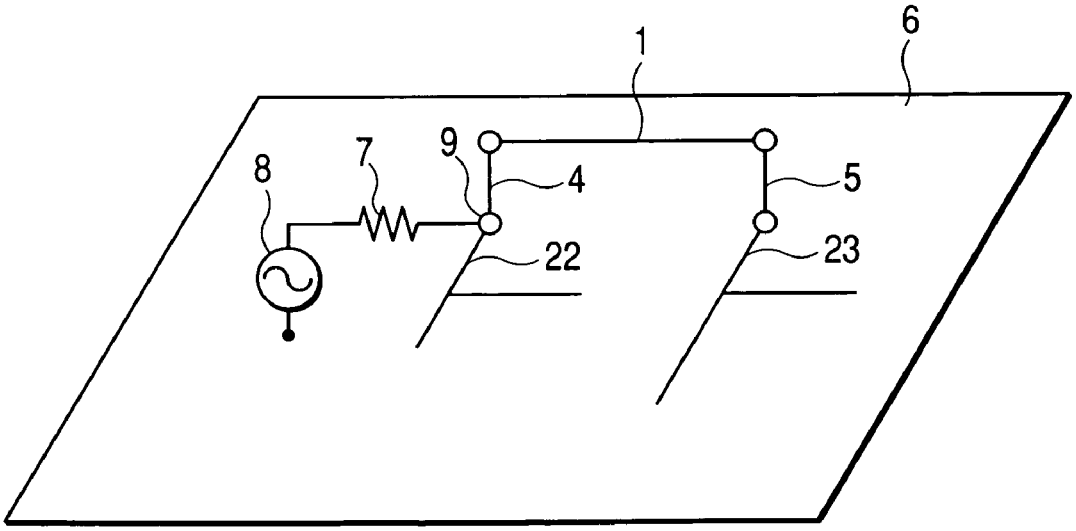
FIG. 4 is a configuration diagram illustrating a third embodiment of the invention.
Figure 5B:
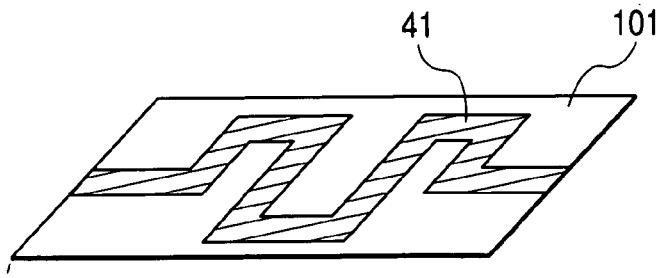
FIGS. 5(*a*), 5(*b*), 5(*c*), 5(*d*), and 5(*e*) are configuration diagrams illustrating a fourth embodiment of the invention.
Figure 5C:
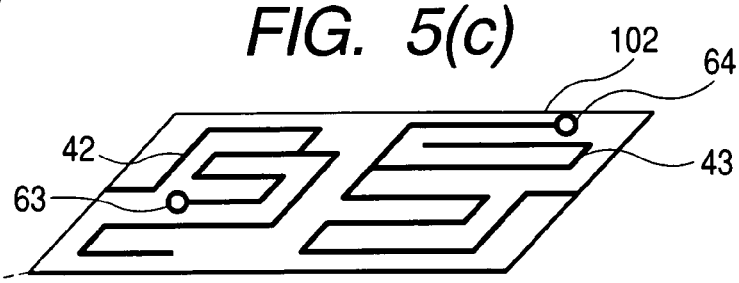
Figure 5A:
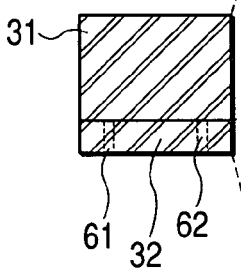
Figure 5D:
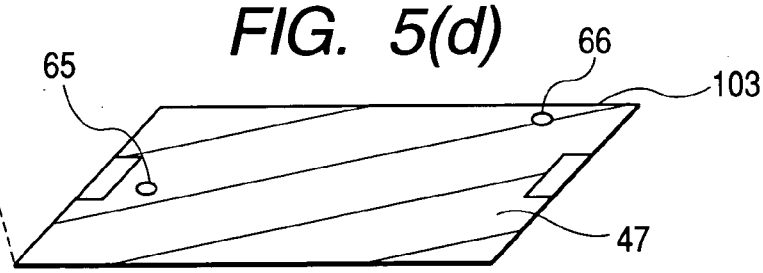
Figure 5E:
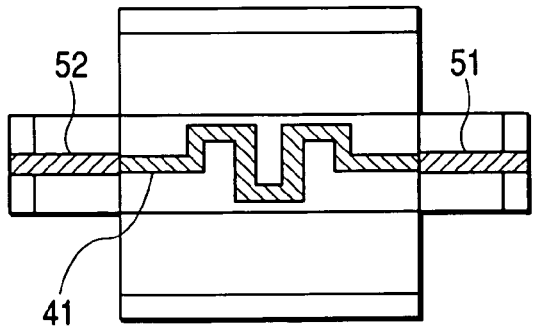
Figure 6B:
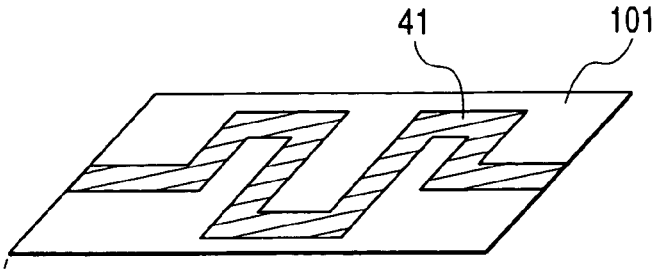
FIGS. 6(*a*), 6(*b*), 6(*c*), 6(*d*) and 6(*e*) are configuration diagrams illustrating a fifth embodiment of the invention.
Figure 6A:
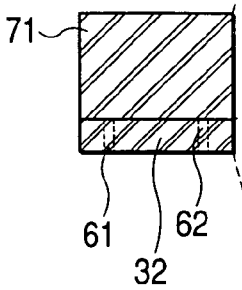
Figure 6C:
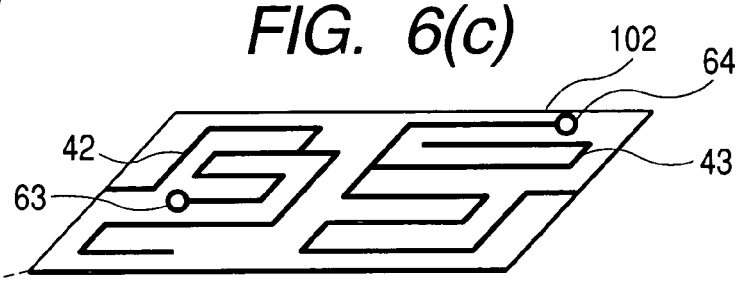
Figure 6D:
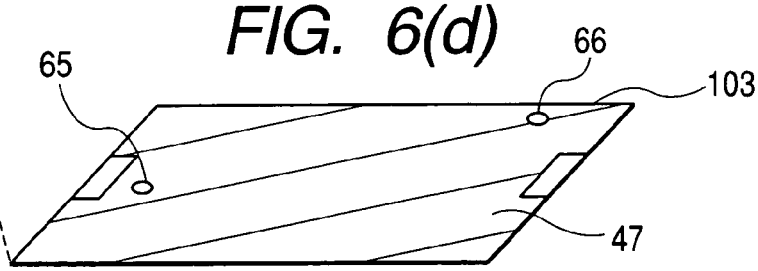
Figure 6E:
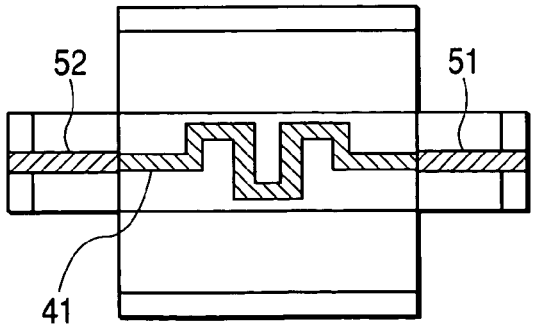
Figure 7B:
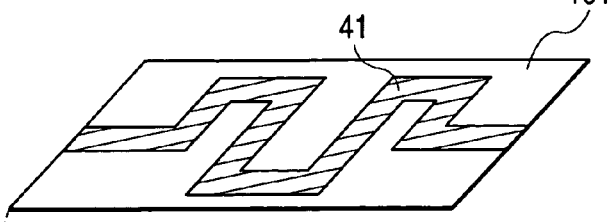
FIGS. 7(*a*), 7(*b*), 7(*c*), 7(*d*), 7(*e*) and 7(*f*) are configuration diagrams illustrating a sixth embodiment of the invention.
Figure 7C:
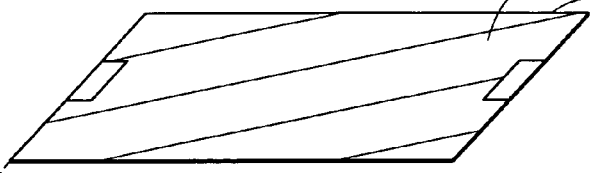
Figure 7A:
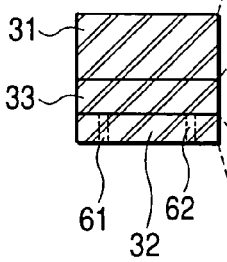
Figure 7D:
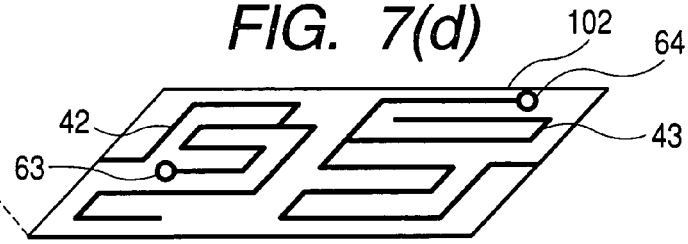
Figure 7E:
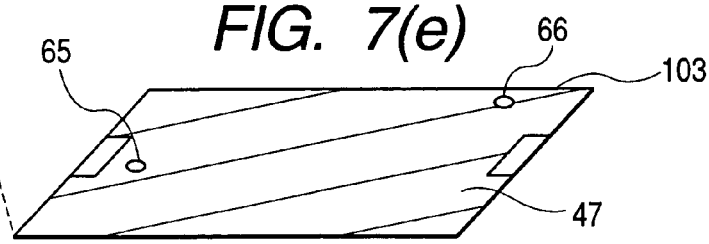
Figure 7F:
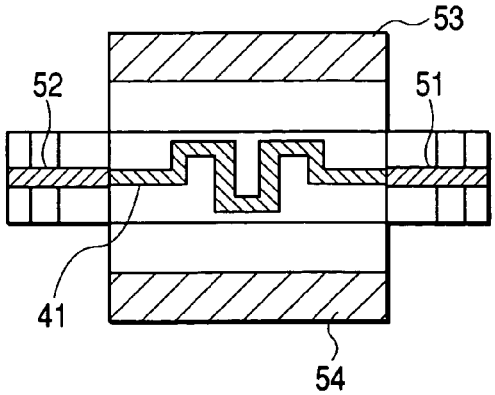
Figure 8B:
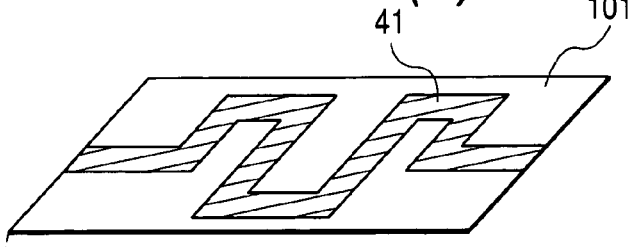
FIGS. 8(*a*), 8(*b*), 8(*c*), 8(*d*), 8(*e*) and 8(*f*) are configuration diagrams illustrating a seventh embodiment of the invention.
Figure 8C:
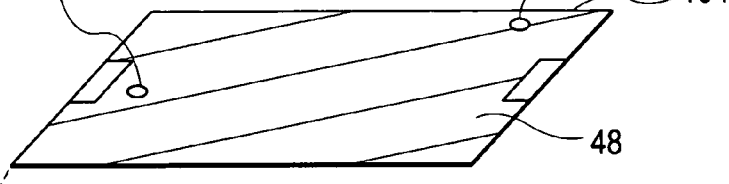
Figure 8A:
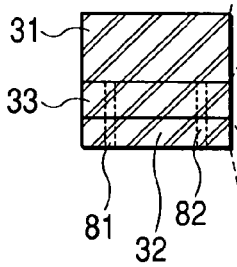
Figure 8D:
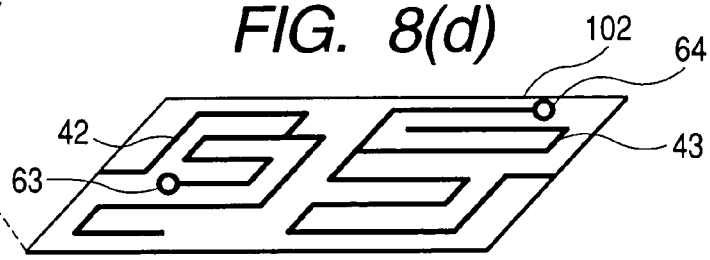
Figure 8E:
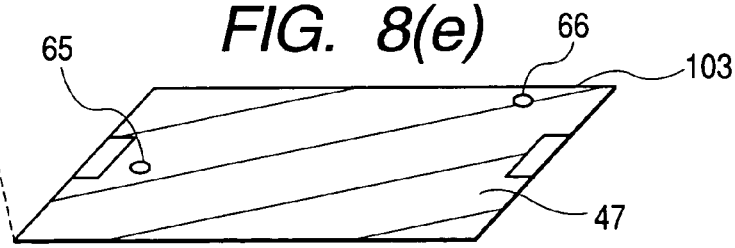
Figure 8F:
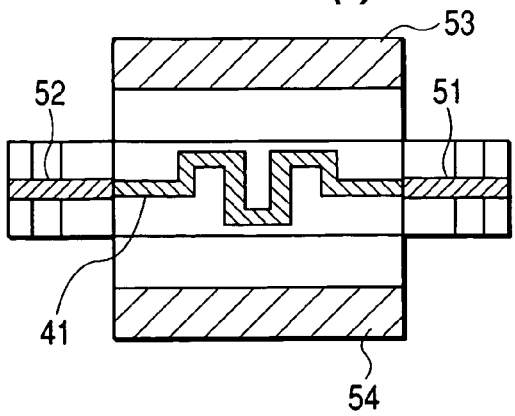
Figure 9B:
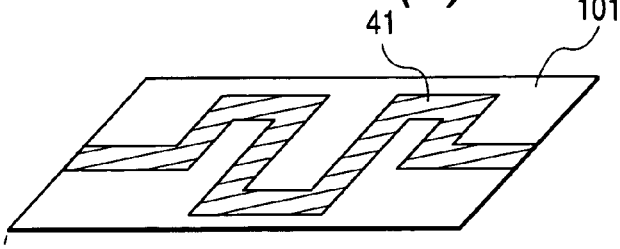
FIGS. 9(*a*), 9(*b*), 9(*c*), 9(*d*), 9(*e*) and 9(*f*) are configuration diagrams illustrating an eighth embodiment of the invention.
Figure 9C:
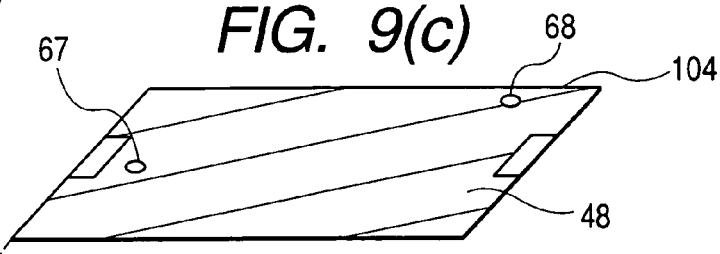
Figure 9A:
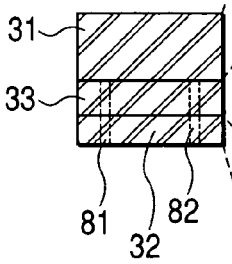
Figure 9D:
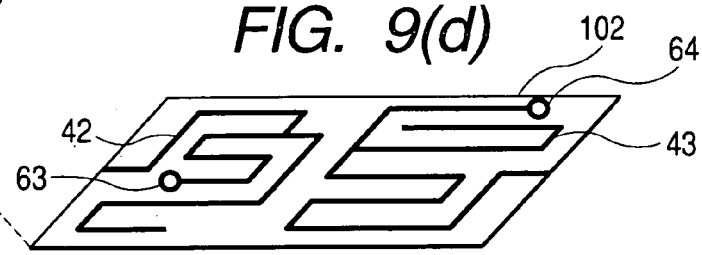
Figure 9E:
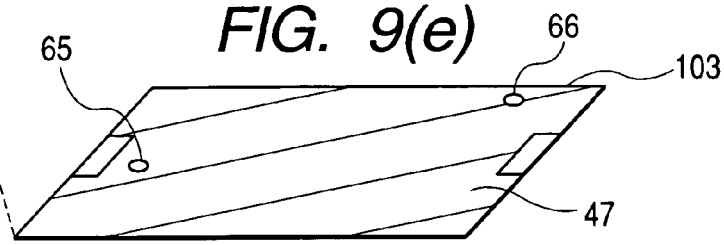
Figure 9F:
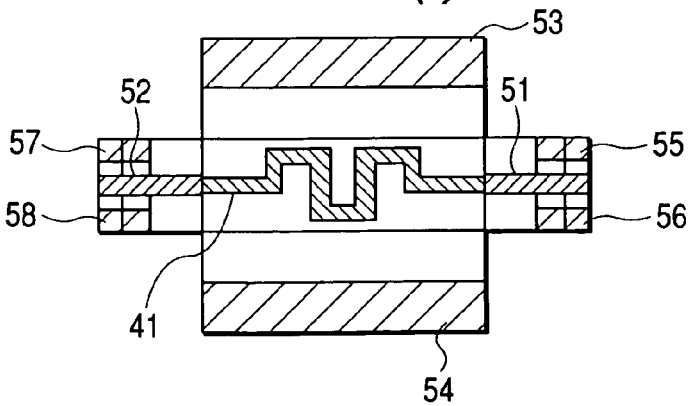

To make the antenna of the embodiment operate as an antenna adapted to different carrier frequencies, the admittances at the carrier frequencies, which is seen toward the antenna side from the feeding point 9, have to exist near the point A or B in FIG. 4. There are options that admittances exist near the points A and A, B and B, A and B, or B and A in the frequency increasing direction in correspondence with the carrier frequencies. The optimum combination is selected by the ratio between the absolute value of the admittance at each of different carrier frequencies and the frequency, and a ratio of a matching band width at each carrier wave requested to the antenna.

According to the embodiment, in the single feeding point 9, excellent impedance matching is realized between the RF circuit part and the free space at a plurality of different frequencies. Consequently, RF powers from the RF circuit part are led to the antenna and electric waves of a plurality of frequencies can be efficiently radiated from the antenna. In addition, energies of electric waves of a plurality of frequencies coming to the antenna can be efficiently transmitted to the RF circuit part. That is, according to the invention, a multimode antenna suitable for a multimedia wireless apparatus providing a plurality of information transmission services to the user by using carrier waves of different frequencies can be realized.

Figure 3:
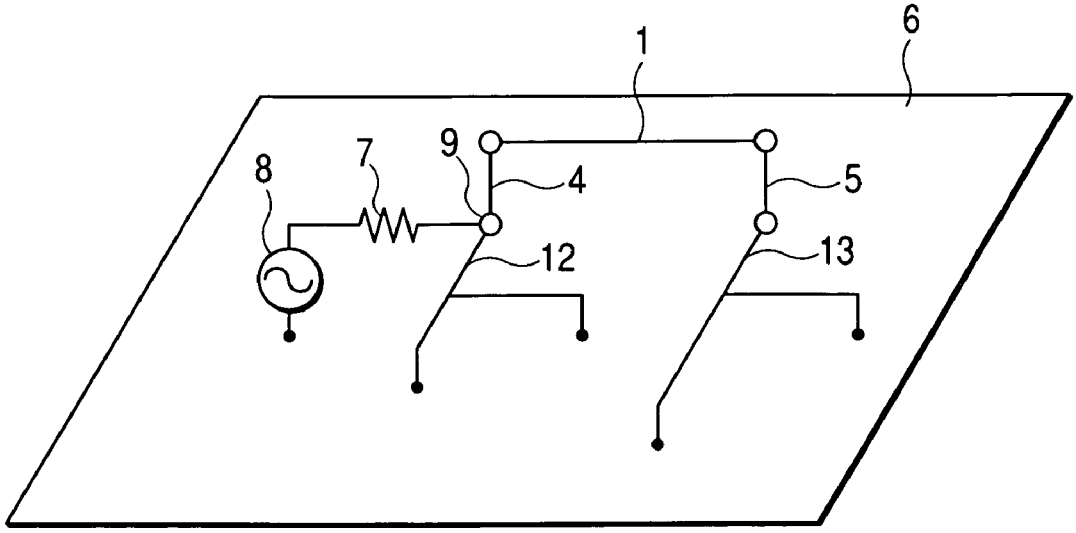
FIG. 3 is a configuration diagram illustrating a second embodiment of the invention.

A second embodiment of the invention will be described with reference to FIG. 3. FIG. 3 is a diagram showing components of an antenna according to the invention and the coupling relations of the components. The point different from the embodiment of FIG. 1 is that a wire conductor 12 having a first branch and a wire conductor 13 having a second branch are used in place of the wire conductor 2 having the first branch and the wire conductor 3 having the second branch. To the first branch of the wire conductor 12, a wire conductor whose one end is connected to the ground 6 and a wire conductor whose one end is similarly connected to the ground 6 are connected. To the second branch of the wire conductor 13, a wire conductor whose one end is connected to the ground 6 and a wire conductor whose one end is similarly connected to the ground 6 are connected.

The wire conductor 12 having the first branch and the wire conductor 13 having the second branch can be expressed by an equivalent circuit in which two different short stubs are connected in parallel with the transmission line. Also in the second embodiment, by setting the length of the short stub to the ¼ wavelength at a frequency to which the antenna is to have sensitivity, designing of the wire conductor 12 having the first branch and the wire conductor 13 having the second branch can be simplified. Effects of the embodiment are similar to those of the embodiment of FIG. 1. The second embodiment has effects that, when the ratio of the frequencies of different carrier waves to which the antenna has sensitivity is close to integer times, the wire conductor 12 having the first branch and the wire conductor 13 having the second branch can be realized in a small conductor area.

A third embodiment of the invention will be described by using FIG. 4. FIG. 4 is a diagram showing components of an antenna according to the invention and the coupling relations of the components. The point different from the embodiment of FIG. 1 is that a wire conductor 22 having a first branch and a wire conductor 23 having a second branch are used in place of the wire conductor 2 having the first branch and the wire conductor 3 having the second branch. Two wire conductors each having one open end are connected to the first branch of the wire conductor 22, and two wire conductors each having one open end are connected to the second branch of the wire conductor 23.

The wire conductor 22 having the first branch and the wire conductor 23 having the second branch can be expressed by an equivalent circuit in which two different open stubs are connected in parallel with the transmission line. Also in the embodiment, by setting the length of one open stub to the ½ wavelength at a frequency to which the antenna is to have sensitivity, designing of the wire conductor 22 having the first branch and the wire conductor 23 having the second branch can be simplified.

Effects of the embodiment are similar to those of the embodiment of FIG. 1. In the third embodiment, when the frequencies of different carrier waves to which the antenna is to have sensitivity are as high as tens GHz or more, the wire conductor 22 having the first branch and the wire conductor 23 having the second branch can be realized by in proper dimensions without making the wire conductors 22 and 23 extremely short. Therefore, the embodiment has an effect that the influence on the antenna characteristics of a manufacture dimensional error of the wire conductors each having a branch can be reduced.

A fourth embodiment of the invention will be described with reference to FIGS. 5(*a*) to 5(*e*). FIGS. 5(*a*) to 5(*e*) are diagrams showing the structure of an antenna constructed by using a multilayer substrate. The layers of the multilayer substrate are, in order from the top, an uppermost layer 101, an intermediate layer 102, and a lowest layer 103. FIG. 5(*a*) is a cross section seen from a side face of the antenna, FIG. 5(*b*) shows a radiating conductor pattern 41 formed in the uppermost layer 101, FIG. 5(*c*) shows a stripline pattern 42 having the first branch and a stripline pattern 43 having a second branch formed in the intermediate layer 102, FIG. 5(*d*) shows a ground conductor pattern 47 formed in the lowest layer 103, and FIG. 5(*e*) is a surface expansion plan excluding the lowest layer 103 as an earth layer of the antenna.

An end of the radiating conductor pattern 41 and the stripline pattern 42 having the first branch are electrically coupled to each other via a first side conductor pattern 52. The other end of the radiating conductor pattern 41 and the stripline pattern 43 having the second branch are electrically coupled to each other via a second side conductor pattern 51.

Couplings of the uppermost layer 101 and intermediate layer 102, and the second connecting conductor and lowest layer 103 are made by an upper dielectric substrate 31 and a lower dielectric substrate 32 made of the same material in this order. Although the permittivity of the dielectric substrate 31 and that of the dielectric substrate 32 are the same since their materials are the same, it can be set so that the product of permittivity and permeability of each substrate does not increase in the direction from the ground conductor pattern 47 to the radiating conductor pattern 41. Other than the dielectric substrates, magnetic substrates can be used for coupling the layers.

A first through hole land 63 is formed at one end of the stripline pattern 42 having the first branch. The first through hole land 63 is electrically coupled with a third through hole land 65 formed in the ground conductor pattern 47 via a first through hole 62 formed in the lower dielectric substrate 32.

A second through hole land 64 is formed at one end of the stripline pattern 43 having the second branch. The second through hole land 64 is electrically coupled with a fourth through hole 66 formed in the ground conductor pattern 47 via a second through hole 61 formed in the lower dielectric substrate 32.

According to the fourth embodiment, the ground conductor pattern 47 is coupled to the earth of the RF circuit part and the first side conductor pattern 52 is coupled to a signal line of the RF circuit part, thereby enabling the antenna of the embodiment of FIG. 1 to be embodied by a multilayer substrate process capable of performing mass production. Therefore, the embodiment has an effect such that the multimode antenna suitable to be applied to a multimode wireless apparatus can be manufactured at low cost by the mass production effect.

A fifth embodiment of the invention will be described by using FIGS. 6(*a*) to 6(*e*). FIGS. 6(*a*) to 6(*e*) are diagrams showing the structure of an antenna constructed by using a multilayer substrate. The layers of the multilayer substrate are, in order from the top, the uppermost layer 101, the intermediate layer 102, and the lowest layer 103. FIG. 6(*a*) is a cross section seen from a side face of the antenna, FIG. 6(*b*) shows the radiating conductor pattern 41 formed in the uppermost layer 101, FIG. 6(*c*) shows the stripline pattern 42 having the first branch and the stripline pattern 43 having a second branch formed in the intermediate layer 102, FIG. 6(*d*) shows the ground conductor pattern 47 formed in the lowest layer 103, and FIG. 6(*e*) is a surface expansion plan excluding the lowest layer 103 as an earth layer of the antenna.

The point different from the fourth embodiment shown in FIGS. 5(*a*) to 5(*e*) is that the uppermost layer 101 and the intermediate layer 102 are coupled by an upper dielectric substrate 71 having permittivity lower than that of the lower dielectric substrate 32 for coupling the intermediate layer 102 and the lowest layer 103.

In the embodiment, the strength of electromagnetic coupling between the radiating conductor pattern 41 and the stripline pattern 42 having the first branch and the stripline pattern 43 having the second branch can be reduced. Thus, designing of the stripline patterns 42 and 43 each having the branch can be facilitated as compared with that of the embodiment of FIGS. 5(*a*) to 5(*e*).

A sixth embodiment of the invention will be described by using FIGS. 7(*a*) to 7(*f*). FIGS. 7(*a*) to 7(*f*) are diagrams showing the structure of an antenna constructed by using a multilayer substrate. The layers of the multilayer substrate are, in order from the top, the uppermost layer 101, an intermediate insulating layer 104, the intermediate layer 102, and the lowest layer 103. FIG. 7(*a*) is a cross section seen from a side face of the antenna, FIG. 7(*b*) shows the radiating conductor pattern 41 formed in the uppermost layer 101, FIG. 7(*c*) shows a conducting pattern 48 formed on the intermediate insulating layer 104, FIG. 7(*d*) shows the stripline pattern 42 having the first branch and the stripline pattern 43 having the second branch formed in the intermediate layer 102, FIG. 7(*e*) shows the ground conductor pattern 47 formed in the lowest layer 103, and FIG. 7(*f*) is a surface expansion plan excluding the lowest layer 103 as an earth layer of the antenna.

An end of the radiating conductor pattern 41 and the stripline pattern 42 having the first branch are electrically coupled to each other via the first side conductor pattern 52.

The other end of the radiating conductor pattern 41 and the stripline pattern 43 having the second branch are electrically coupled to each other via the second side conductor pattern 51.

The conducting pattern 48 is electrically coupled to the ground conductor pattern 47 via a third side conductor pattern 53 and a fourth side conductor pattern 54.

Couplings of the uppermost layer 101 and intermediate insulating layer 104, the intermediate insulating layer 104 and intermediate layer 102, and the intermediate layer 102 and lowest layer 103 are made by the upper dielectric substrate 31, an intermediate dielectric substrate 33, and the lower dielectric substrate 32 made of the same material in this order.

The first through hole land 63 is formed at one end of the stripline pattern 42 having the first branch. The first through hole land 63 is electrically coupled with the third through hole land 65 formed in the ground conductor pattern 47 via the first through hole 62 formed in the lower dielectric substrate 32.

The second through hole land 64 is formed at one end of the stripline pattern 43 having the second branch. The second through hole land 64 is electrically coupled with a fourth through hole land 66 formed in the ground conductor pattern 47 via the second through hole 61 formed in the lower dielectric substrate 32.

In the embodiment, the strength of electromagnetic coupling between the radiating conductor pattern 41 and the stripline pattern 42 having the first branch and the stripline pattern 43 having the second branch can be noticeably reduced. Thus, designing of the stripline patterns 42 and 43 each having the branch can be facilitated as compared with that of the embodiment of FIGS. 5(*a*) to 5(*e*) and the thickness of the upper dielectric substrate can be reduced, so that it is effective at decreasing the volume of the antenna.

A seventh embodiment of the invention will be described by using FIGS. 8(*a*) to 8(*f*). FIGS. 8(*a*) to 8(*f*) are diagrams showing the structure of an antenna constructed by using a multilayer substrate. The layers of the multilayer substrate are, in order from the top, the uppermost layer 101, the intermediate insulating layer 104, the intermediate layer 102, and the lowest layer 103. FIG. 8(*a*) is a cross section seen from a side face of the antenna, FIG. 8(*b*) shows the radiating conductor pattern 41 formed in the uppermost layer 101, FIG. 8(*c*) shows the conducting pattern 48 formed on the intermediate insulating layer 104, FIG. 8(*d*) shows the stripline pattern 42 having the first branch and the stripline pattern 43 having the second branch formed in the intermediate layer 102, FIG. 8(*e*) shows the ground conductor pattern 47 formed in the lowest layer 103, and FIG. 8(*f*) is a surface expansion plan excluding the lowest layer 103 as an earth layer of the antenna.

The following two points are different from the sixth embodiment shown in FIGS. 7(*a*) to 7(*f*). The first point is that the first through hole land 63 formed at one end of the stripline pattern 42 having the first branch is electrically coupled with the third through hole land 65 formed in the ground conductor pattern 47 and a fifth through hole land 67 formed in the conducting pattern 48 via a third through hole 82 formed in the intermediate dielectric substrate 33 and the lower dielectric substrate 32. The second point is that the second through hole land 64 formed at one end of the stripline pattern 43 having the second branch is electrically coupled with the fourth through hole land 66 formed in the ground conductor pattern 47 and a sixth through hole land 68 formed in the conducting pattern 48 via a fourth through hole 81 formed so as to penetrate the intermediate dielectric substrate 33 and the lower dielectric substrate 32.

In the embodiment, as compared with the sixth embodiment shown in FIGS. 7(*a*) to 7(*f*), the strength of electromagnetic coupling between the radiating conductor pattern 41 and the stripline pattern 42 having the first branch and the stripline pattern 43 having the second branch can be noticeably reduced. Thus, designing of the stripline patterns 42 and 43 each having the branch can be facilitated as compared with that of the embodiment of FIGS. 7(*a*) to 7(*f*).

An eighth embodiment of the invention will be described by using FIGS. 9(*a*) to 9(*f*). FIGS. 9(*a*) to 9(*f*) are diagrams showing the structure of an antenna constructed by using a multilayer substrate. The layers of the multilayer substrate are, in order from the top, the uppermost layer 101, the intermediate insulating layer 104, the intermediate layer 102, and the lowest layer 103. FIG. 9(*a*) is a cross section seen from a side face of the antenna, FIG. 9(*b*) shows the radiating conductor pattern 41 formed in the uppermost layer 101, FIG. 9(*c*) shows the conducting pattern 48 formed on the intermediate insulating layer 104, FIG. 9(*d*) shows the stripline pattern 42 having the first branch and the stripline pattern 43 having the second branch formed in the intermediate layer 102, FIG. 9(*e*) shows the ground conductor pattern 47 formed in the lowest layer 103, and FIG. 9(*f*) is a surface expansion plan excluding the lowest layer 103 as an earth layer of the antenna.

The point different from the seventh embodiment shown in FIGS. 8(*a*) to 8(*f*) is that electrical coupling between the conducting pattern 48 and the ground conductor pattern 47 is enhanced by a fifth side conductor pattern 55, a sixth side conductor pattern 56, a seventh side conductor pattern 57, and an eighth side conductor pattern 58.

According to the eighth embodiment, the strength of electromagnetic coupling between the radiating conductor pattern 41 and the stripline pattern 42 having the first branch and the stripline pattern 43 having the second branch can be noticeably reduced. Thus, designing of the stripline patterns 42 and 43 each having the branch can be facilitated as compared with that of the embodiment of FIGS. 8(*a*) to 8(*f*).

Figures 10A, 10B, 10C, 10D, 10E, 10F, 10G, 10H:
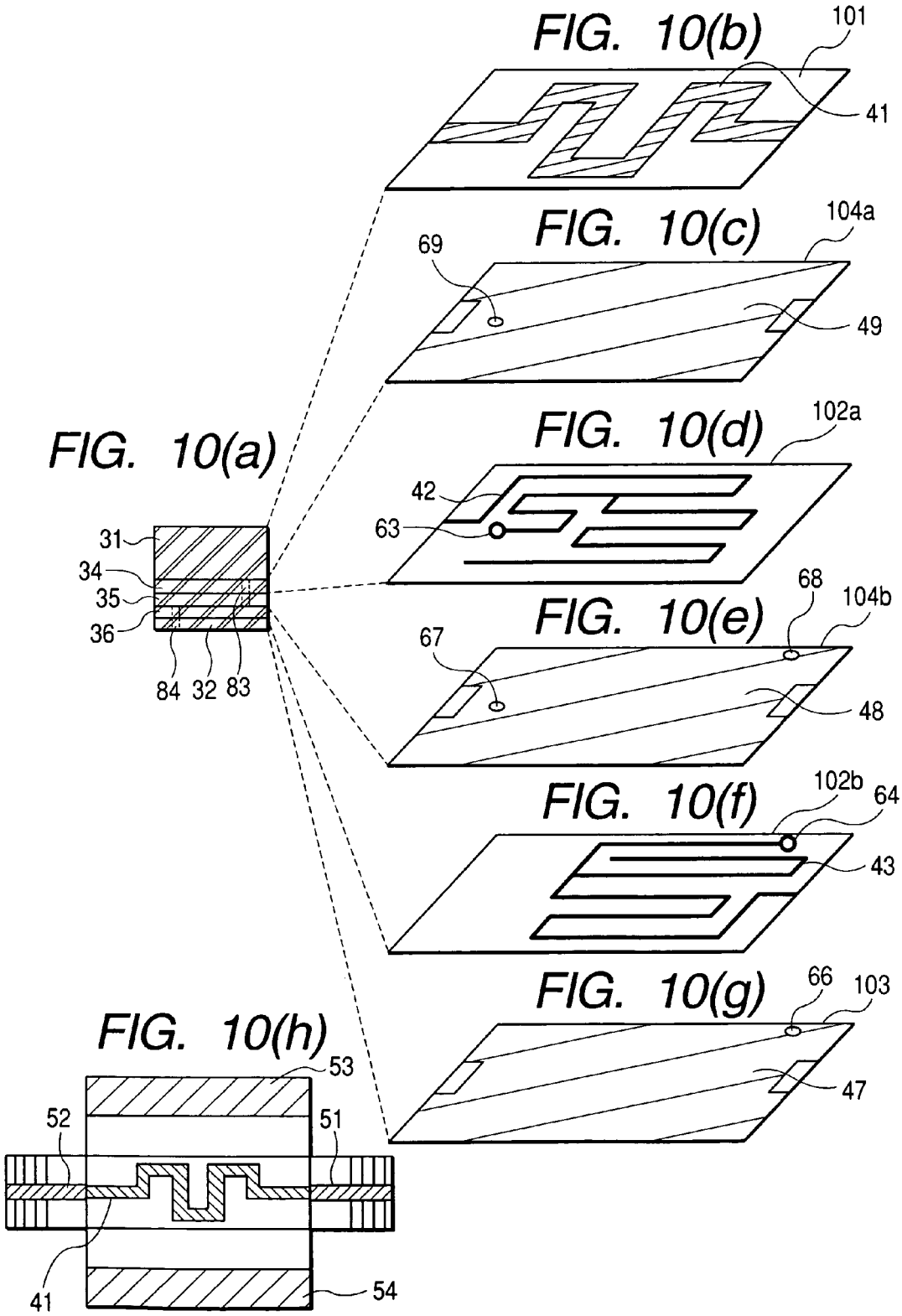
FIGS. 10(*a*), 10(*b*), 10(*c*), 10(*d*), 10(*e*), 10(*f*), 10(*g*) and 10(*h*) are configuration diagrams illustrating a ninth embodiment of the invention.

A ninth embodiment of the invention will be described by using FIGS. 10(*a*) to 10(*h*). FIGS. 10(*a*) to 10(*h*) are diagrams showing the structure of an antenna constructed by using a multilayer substrate. The layers of the multilayer substrate are, in order from the top, the uppermost layer 101, a first intermediate insulating layer 104*a*, a first intermediate layer 102*a*, a second intermediate insulating layer 104*b*, a second intermediate layer 102*b*, and the lowest layer 103.

FIG. 10(*a*) is a cross section seen from a side face of the antenna, FIG. 10(*b*) shows the radiating conductor pattern 41 formed in the uppermost layer 101, FIG. 10(*c*) shows a first conducting pattern 49 formed on the first intermediate insulating layer 104*a*, FIG. 10(*d*) shows the stripline pattern 42 having the first branch formed in the first intermediate layer 102*a*, FIG. 10(*e*) shows the second conducting pattern 48 formed on the second intermediate insulating layer 104*b*, FIG. 10(*f*) shows the stripline pattern 43 having the second branch formed in the second intermediate layer 102*b*, FIG. 10(*g*) shows the ground conductor pattern 47 formed in the lowest layer 103, and FIG. 10(*h*) is a surface expansion plan excluding the lowest layer 103 as an earth layer of the antenna.

An end of the radiating conductor pattern 41 and the stripline pattern 42 having the first branch are electrically coupled to each other via the first side conductor pattern 52. The other end of the radiating conductor pattern 41 and the stripline pattern 43 having the second branch are electrically coupled to each other via the second side conductor pattern 51.

The first conducting patterns 49 and the second conducting pattern 48 are electrically coupled to the ground conductor pattern 47 via the third side conductor patterns 53 and the fourth side conductor pattern 54.

Couplings of the uppermost layer 101 and first intermediate insulating layer 104*a*, the first intermediate insulating layer 104*a* and first intermediate layer 102*a*, the first intermediate layer 102*a* and second intermediate insulating layer 104*b*, the second intermediate insulating layer 104*b* and second intermediate layer 102*b*, and the second intermediate layer 102*b* and lowest layer 103 are coupled to each other by the upper dielectric substrate 31, a first intermediate dielectric substrate 34, a second intermediate dielectric substrate 35, a third intermediate dielectric substrate 36, and the lower dielectric substrate 32 made of the same material in this order.

The first through hole land 63 is formed at one end of the stripline pattern 42 having the first branch. The first through hole land 63 is electrically coupled with a seventh through hole land 69 formed in the intermediate conducting pattern 49 and the fifth through hole land 67 formed in the ground conductor pattern 48 via a third through hole 83 formed so as to penetrate the first and second intermediate dielectric substrates 34 and 35.

The second through hole land 64 is formed at one end of the stripline pattern 43 having the second branch. The second through hole land 64 is electrically coupled with the sixth through hole land 68 formed in the intermediate conducting pattern 48 and the fourth through hole land 66 formed in the intermediate conducting pattern 47 via a fourth through hole 84 formed so as to penetrate the second intermediate dielectric substrate 36 and the lower dielectric substrate 32.

In the embodiment, the area for forming the stripline pattern 42 having the first branch and the stripline pattern 43 having the second branch can be increased, so that the flexibility of designing of the stripline patterns 42 and 43 each having the branch can be increased as compared with the embodiments of FIGS. 5(*a*) to 9(*f*). Therefore, the applicable frequency range of the antenna of the invention can be widened. It produces an effect such that the variety of wireless systems to which the antenna of the invention can be applied can be increased.

Figure 11:
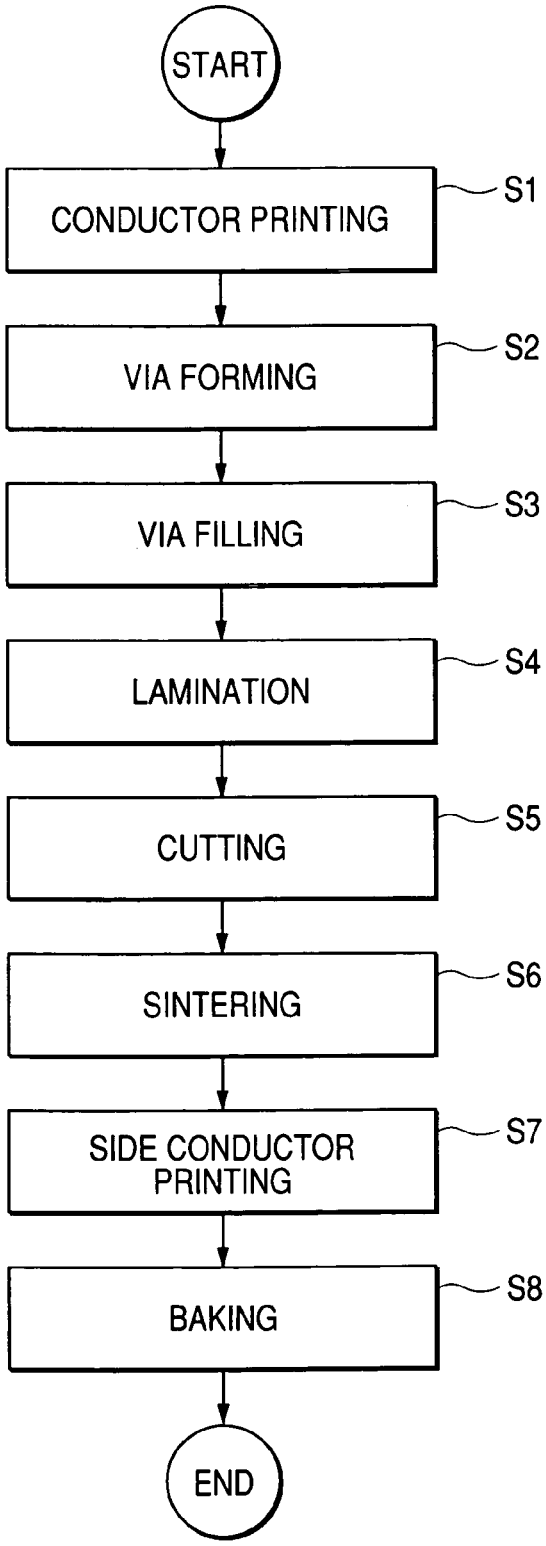
FIG. 11 is a flow chart of manufacturing antenna illustrating a tenth embodiment of the invention.

A tenth embodiment of the invention will be described with reference to FIG. 11. A method for manufacturing an antenna of the invention as a tenth embodiment will be described. FIG. 11 is a flowchart showing process for manufacturing a number of antennas in a lump.

First, on the basis of ceramic multilayer substrate process, the conductor patterns of the layers of the antenna are formed by a conductor printing process (step S1). Next, a via forming process (step S2) and a via filling process (step S3) are performed for forming through holes of the antenna.

Subsequently, a lamination process is performed for joining the layers together (step S4) and antennas formed in a lump in a sheet are cut into an antenna respectively (step S5). After that, a sintering process is performed (step S6), the side conductor structure of the antenna is formed by a side conductor printing process (step S7) and, finally, a baking process (step S8) is performed, thereby obtaining products.

Since a number of antennas applied to multimedia wireless apparatuses can be manufactured in a lump by the normal ceramic multilayer substrate process effective to mass production, the embodiment is effective at reducing the cost of the antenna.

Figure 12:
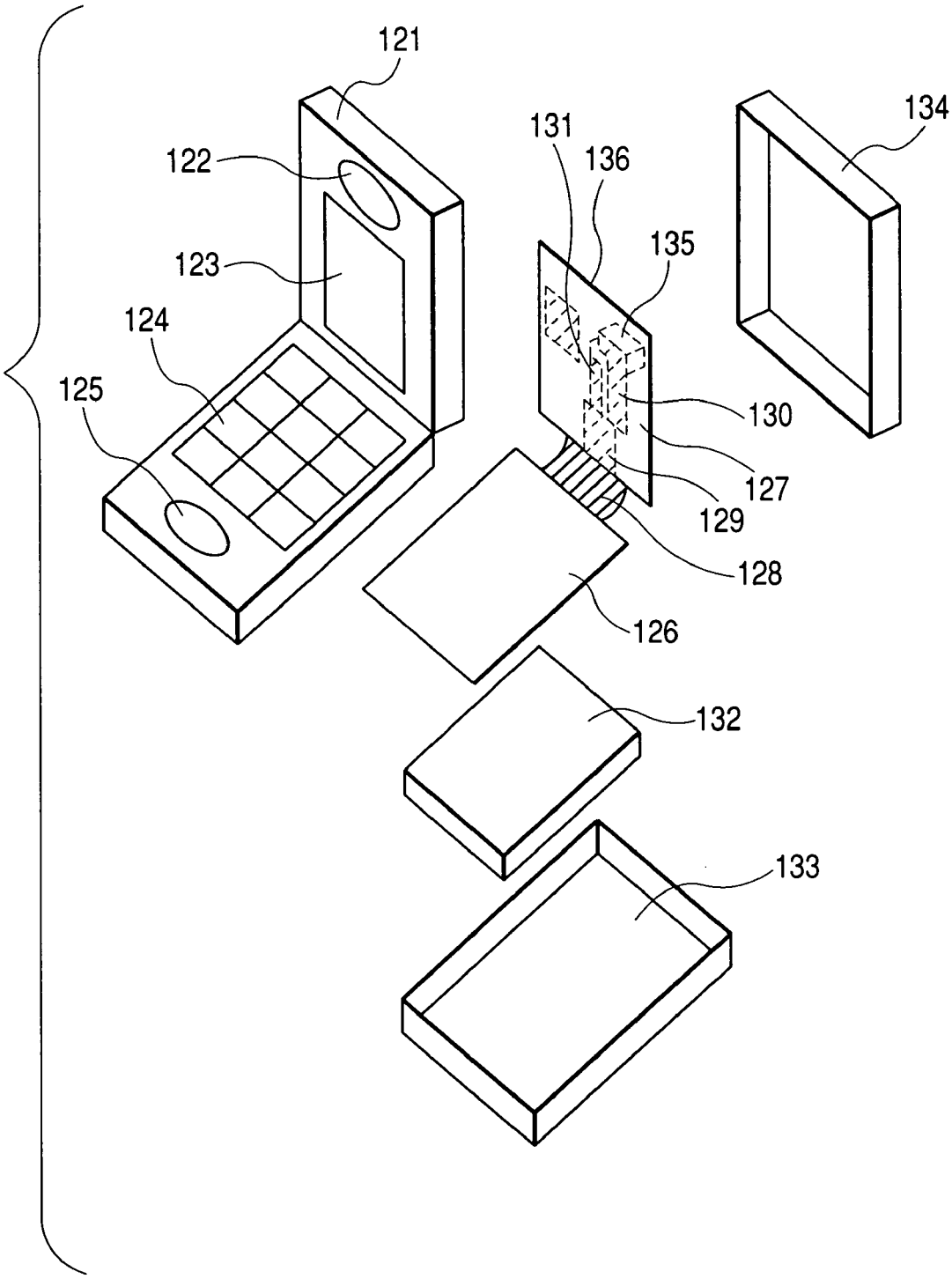
FIG. 12 is a configuration diagram showing an eleventh embodiment of the invention.

An eleventh embodiment of the invention will be described with reference to FIG. 12. FIG. 12 shows a communication apparatus on which the antenna according to the invention is mounted.

As shown in FIG. 12, on a folding-type surface body 121, a speaker 122, a display 123, a keypad 124, and a microphone 125 are mounted. On the inside of the surface body 121 covered with a first rear body 133 and a second rear body 134, a first circuit board 126 and a second circuit board 127 connected via a flexible cable 128, an antenna 135 of the invention, and a battery 132 are housed.

On the top face (on the rear body 134 side) 136 of the circuit board 127, the antenna 135 and an RF circuit part 129 are mounted, and a ground conductor pattern 130 coupled to the earth of the RF circuit part 129 and a signal conductor pattern 131 connected to a signal input-output point of the RF circuit part 129 are formed. The ground conductor pattern of the antenna 135 is in contact with the top face 136 of the board 127, the ground conductor pattern 130 and the earth side of the feeding point of the antenna 135 are coupled to each other, and the signal conductor pattern 131 and the driving side of the feeding point of the antenna 135 are coupled to each other.

The structure shown in FIG. 12 is characterized in that the antenna 135 of the invention is positioned on the side opposite to the display 123 and the speaker 122 over the circuit board 127.

According to the embodiment, a wireless apparatus enjoying services of a plurality of wireless systems can be realized by the form including the antenna. Thus, the embodiment is effective at reducing the size of the wireless apparatus and improving the stored ability and the portability for the user.

Figure 13:
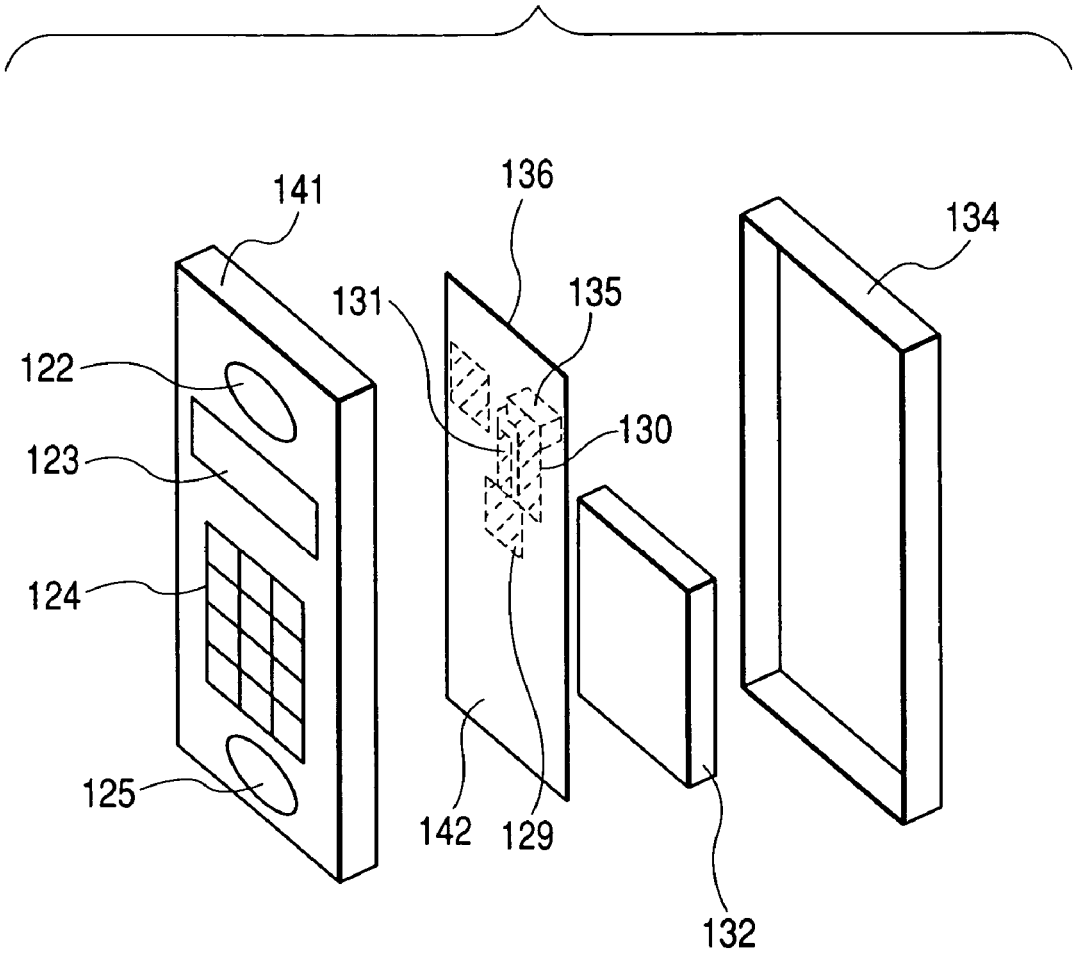
FIG. 13 is a configuration diagram showing a twelfth embodiment of the invention.

A twelfth embodiment of the invention will be described with reference to FIG. 13. FIG. 13 shows another communication apparatus on which the antenna of the invention is mounted.

As shown in FIG. 13, the speaker 122, display 123, keypad 124, and microphone 125 are mounted on a surface body 141. On the inside of the surface body 141 covered with the rear body 134, a circuit board 142, the antenna 135 of the invention, and the battery 132 are housed.

On the top face (on the rear body 134 side) 136 of the circuit board 142, the antenna 135 and the RF circuit part 129 are mounted, and the ground conductor pattern 130 coupled to the earth of the RF circuit part 129 and the signal conductor pattern 131 connected to the signal input-output point of the RF circuit part 129 are formed. The ground conductor pattern of the antenna 135 is in contact with the top face 136 of the board 142, the ground conductor pattern 130 and the earth side of the feeding point of the antenna 135 are coupled to each other, and the signal conductor pattern 131 and the driving side of the feeding point of the antenna 135 are coupled to each other.

The structure is characterized in that the antenna 135 of the invention is positioned on the side opposite to any of the display 123, microphone 125, speaker 122 and keypad 124 over the circuit board 142.

According to the embodiment, a wireless apparatus enjoying services of a plurality of wireless systems can be realized by the form including the antenna. Thus, the embodiment is effective at reducing the size of the wireless apparatus and improving the stored ability and the portability for the user. Different from the embodiment of FIG. 12, the circuit board and the bodies can be integrally manufactured, so that the twelfth embodiment is effective at reducing the manufacturing cost due to reduction in the volume of the apparatus and the number of assembling processes.

According to the invention, excellent impedance matching between the RF circuit part and the free space can be realized by a single feeding point at a plurality of frequencies. Thus, the multimode antenna suitable for a multimedia wireless apparatus for providing plural information transmission services to the user by using carrier waves of different frequencies can be realized. Since a single feeding point is used, the RF circuit handling a plurality of carrier waves can be integrated. Therefore, the RF circuit handling the plurality of carrier waves and the antenna can be mounted on a single RF module, and effects of reduction in the size of the multimedia wireless apparatus and the manufacturing cost and improvement in sensitivity of the apparatus can be obtained.

It is further understood by those skilled in the art that the foregoing description is a preferred embodiment of the disclosed device and that various changes and modifications may be made in the invention without departing from the spirit and scope thereof.

What is claimed is:

1. An antenna comprising:

a radiating conductor disposed above a ground conductor; and first and second distributed-constant circuits coupled to said radiating conductor, wherein each of said first and second distributed-constant circuits is constructed by a transmission line and has a branch, wherein one end of said radiating conductor and one end of said first distributed-constant circuit are connected to each other and, further, the other end of said radiating conductor and one end of said second distributed-constant circuit are connected to each other, and wherein a connection point of the one end of said radiating conductor and the one end of said first distributed-constant circuit is a single feeding point using said ground conductor as an earth.

2. The antenna according to claim 1, wherein different stubs are connected to said first and second distributed-constant circuits respectively.

3. The antenna according to claim 1, wherein said first and second distributed-constant circuits are disposed below said radiating conductor between said radiating conductor and said ground conductor.

4. The antenna according to claim 3, wherein each of said first and second distributed-constant circuits is made of striplines.

5. The antenna according to claim 1, wherein each of said first and second distributed-constant circuits is made of coaxial lines.

6. The antenna according to claim 4, wherein a conductor having an earth is disposed between said radiating conductor and said first and second distributed-constant circuits.

7. The antenna according to claim 4, wherein a first dielectric substrate is disposed between said radiating conductor and said first and second distributed-constant circuits and a second dielectric substrate is disposed between said first and second distributed-constant circuits and said ground conductor.

8. The antenna according to claim 7, wherein said radiating conductor is constructed by a radiating conductor pattern formed on the top face of said first dielectric substrate, said first and second distributed-constant circuits are constructed by stripline patterns formed on the top face of said second dielectric substrate, said ground conductor is constructed by a ground conductor pattern formed on the rear face of said second dielectric substrate, and a multilayer substrate structure is formed by said first and second dielectric substrates.

9. A method for manufacturing an antenna, wherein said antenna comprises:

a radiating conductor disposed above a ground conductor; and first and second distributed-constant circuits coupled to said radiating conductor, wherein each of said first and second distributed-constant circuits is constructed by a transmission line and has a branch, wherein one end of said radiating conductor and one end of said first distributed-constant circuit are connected to each other and, further, the other end of said radiating conductor and one end of said second distributed-constant circuit are connected to each other, wherein a connection point of the one end of said radiating conductor and the one end of said first distributed-constant circuit is a single feeding point using said ground conductor as an earth, the method comprising the steps of:

forming a radiating conductor pattern as said radiating conductor on the top face of a first dielectric substrate;

forming a stripline pattern as said first and second distributed-constant circuits on the top face of a second dielectric substrate, and forming a ground conductor pattern as said ground conductor on the rear face of said second dielectric substrate;

joining said first and second dielectric substrates on which said conductor patterns are formed; and forming a first side conductor for connecting one end of said radiating conductor and one end of said first distributed-constant circuit and forming a second side conductor for connecting the other end of said radiating conductor and one end of the second distributed-constant circuit, on each of facing side surfaces of said joined first and second dielectric substrates.

10. A communication apparatus comprising:

an RF circuit for generating a transmission signal to be transmitted by radio and processing a signal received by radio;

an antenna connected to an input-output point of said RF circuit;

a circuit board on which said RF circuit and said antenna are mounted; and a body for housing said circuit board, wherein said antenna comprises:

a radiating conductor disposed above a ground conductor; and first and second distributed-constant circuits coupled to said radiating conductor, wherein each of said first and second distributed-constant circuits is constructed by a transmission line and has a branch, wherein one end of said radiating conductor and one end of said first distributed-constant circuit are connected to each other and, further, the other end of said radiating conductor and one end of said second distributed-constant circuit are connected to each other, and wherein a connection point of the one end of said radiating conductor and the one end of said first distributed-constant circuit is a single feeding point using said ground conductor as an earth.

* * * * *